US006729218B2

(12) United States Patent
Somsen

(10) Patent No.: US 6,729,218 B2
(45) Date of Patent: May 4, 2004

(54) DEVICE FOR CUTTING POTATOES OR OTHER VEGETABLES INTO SLICES OR STICKS

(75) Inventor: Dirk Johan Somsen, Zutphen (NL)

(73) Assignee: Aviko B. V., Steenderen (NL)

( * ) Notice: Subject to any disclaimer, the term of this patent is extended or adjusted under 35 U.S.C. 154(b) by 0 days.

(21) Appl. No.: 09/747,096

(22) Filed: Dec. 22, 2000

(65) Prior Publication Data

US 2001/0011491 A1 Aug. 9, 2001

(30) Foreign Application Priority Data

Dec. 23, 1999 (NL) ..... 1013937

(51) Int. Cl.[7] ..... B26D 7/06

(52) U.S. Cl. ..... 83/402; 83/425.2; 83/425.3; 83/857; 83/932

(58) Field of Search ..... 83/402, 857, 858, 83/856, 425, 425.2, 425.3, 932

(56) References Cited

U.S. PATENT DOCUMENTS 4,300,429 A * 11/1981 Brown et al. ..... 83/651.1
4,372,184 A * 2/1983 Fisher et al. ..... 83/98
4,909,139 A * 3/1990 Montano et al. ..... 99/537
5,046,388 A * 9/1991 Mendenhall ..... 83/98
5,191,823 A * 3/1993 Miller et al. ..... 83/857
5,343,623 A * 9/1994 Cole et al. ..... 30/304
5,394,780 A * 3/1995 Foster et al. ..... 83/402
5,568,755 A * 10/1996 Mendenhall ..... 83/402
5,655,428 A 8/1997 Cockburn et al.
5,911,808 A * 6/1999 Mendenhall ..... 83/581.1
6,047,625 A * 4/2000 Mendenhall ..... 83/856
6,129,624 A * 10/2000 Niklason ..... 452/106

* cited by examiner

*Primary Examiner*—Kenneth E. Peterson
*Assistant Examiner*—Omar Flores-Sánchez
(74) *Attorney, Agent, or Firm*—Beck & Tysver, P.L.L.C.

(57) ABSTRACT

A device (1) for cutting potatoes (5) or other vegetables into slices or sticks, comprising a cutting member (2) with a supply tube (3) and a discharge tube (4) connected thereto. The device is designed for moving potatoes (5), by a water stream supplied by the supply tube (3), through the cutting member (2) and discharging them again via the discharge tube (4). In the cutting member (2), a number of knives (9) are arranged. The cutting member comprises a number of segments (6) held together by a casing (11), each segment having an opening (20) which together form a passage for the water stream, while in each opening (20) one or more knives (9, 10) may be provided.

14 Claims, 2 Drawing Sheets

DEVICE FOR CUTTING POTATOES OR OTHER VEGETABLES INTO SLICES OR STICKS

The invention relates to an device for cutting potatoes or other vegetables into slices or sticks, comprising a cutting member having a supply and discharge tube connected thereto, said device being designed for moving potatoes, by a water stream supplied by the supply tube, through the cutting member and discharging them again via the discharge tube, a number of knives being arranged in the cutting member, said cutting member comprising a number of segments which are held together, each segment having an opening which together form a passage for the water stream, while in each opening, one or more knives may be provided.

Such device is known from international patent application WO 88/09711. The device is also referred to as a "water knife", because the potatoes are pumped through the device in a water stream, with the potatoes being moved against the knives with force, so that they are cut into the desired shape. Knives positioned next to and behind one another cut the potatoes into slices. The slices can be cut into sticks if there are also provided transversely positioned knives. After passing the cutting member, the sticks are separated from the water. The water can be reused.

During a production, the knives should be replaceable as soon as possible, because stopping the production in an industrial processing environment involves high costs. The known device consists of loose elements which, for the cutting process of the potatoes, can be assembled into one whole by means of screw bolts. This should be effected with due precision, in order to realize a proper cutting arrangement and to prevent leakage. As it is, leakage may cause transversal flow, as a consequence of which the potatoes are not properly aligned in the longitudinal direction. This causes the sticks to be less dimensionally stable. Moreover, transversal flows may move the potatoes in the direction more or less transverse to the cutting direction, so that the sticks become less long, get damaged or may break and the knives will be deformed sooner. With the known device, replacement of the knives undesirably takes up much time.

The object of the invention is to provide a device for cutting potatoes or other vegetables as set forth in the preamble, wherein the assembly is facilitated and wherein, due to a small number of handgrips, an operative and watertight whole can be assembled. This object is realized with a device wherein the segments are held together by a casing which is closable in a watertight manner by means of closing members.

The advantage hereof is that if a knife breaks or knives become dull, the whole can readily be disassembled and the segments can be replaced separately. When the choice of the cutting result is changed, knives can readily be added and removed. The whole is easy to assemble and disassemble, which is advantageous in terms of cleaning and servicing.

In a further preferred embodiment, end plates are arranged on both sides of the segments, to which plates the respective supply and discharge tubes are connected, which end plates are likewise held together by the casing. Preferably, the segments define the shape of the casing and have such a shape that they take up a fixed mutual position within the casing. On the outside, the segments have a recess, each recess having a mutually unique shape and capable of engaging a correspondingly shaped projecting edge on the inside of the casing. The casing preferably consists of stainless steel and is built up from hinged parts capable of clasping the segments. The closing members enable closing and opening the casing in a fast and easy manner and may be clamping closures. The casing remains free of corrosion formation and closes off the whole so as to be leaktight. The clamping action of the casing also provides for a good form-retaining construction, as a result of which favorable flow properties are realized and the knives are free from vibration. Through the use of the specific shapes, the segments can be inserted into the casing in one manner only, so that mistakes can be ruled out and the whole can be assembled in an efficient manner.

Preferably, the segments merge with one another to form a passage. Preferably, the segments have a disk-shaped, substantially square shape with a round opening, while around the opening, horizontal and/or vertical slots are provided wherein the knives can be secured.

In a preferred embodiment, the knives have the shape of a strip, while the part that can be inserted into the slot has a first thickness, and at the location of the cutting face, the strip has a second thickness which is less than the first thickness, and the thickness of the cutting face, in the direction opposite to the cutting direction, increases to the first thickness. The passage opening may the smaller than usual, and the knives may be supported at their ends over a greater length. This yields a better cutting result, because vibration of the knives can be prevented. The knives may also be of thinner design. Through the use of a thickening of the strip at the fastening points, the rigidity and strength of the knife increase still further. Due to the favorable interior shape, the through-flow is improved and a higher flow rate can be realized, with fewer pressure losses. It is also possible to work with a smaller flow of water to be circulated.

In another preferred embodiment, the segments contain clamping screws whereby the knives can be clamped down in the slots at both ends. This manner of attachment is advantageous over the screwed attachment of the knives. The knives can be replaced more efficiently in that the screws only have to be unscrewed slightly, rather than removed. The segments may be of stainless steel, aluminum or plastic. Through the use of such materials, no corrosion occurs. Moreover, through the use of the two latter materials, the device can keep a relatively low weight.

In a further embodiment, the supply and discharge tubes have a diffuser action. Preferably, the supply tube narrows in the direction of the front end plate and the discharge tube widens in the direction from the rear end plate, with an apex angle of less than 15°, preferably of 7°. Ideally, with such a shape, pressure is converted into flow rate without any losses. Thus, the occurrence of transversal flows can be avoided, so that the potatoes are moved straight in the cutting direction without the sticks getting damaged or breaking.

The invention further relates to a cutting member for a device as mentioned hereinabove, and to a segment for such cutting member.

The invention will hereinafter be specified with reference to the accompanying drawing. In this drawing.

In the drawing, identical parts are designated by identical reference numerals.

Figure 1:
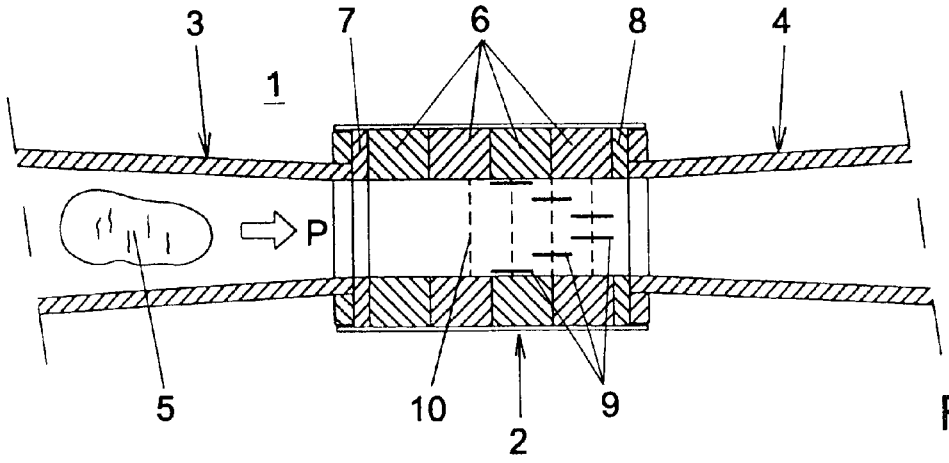
FIG. 1 is a schematic representation of a device according to the invention.

FIG. 1 shows that the device according to the invention (1) is built up from a cutting member (2) having a supply tube (3) and a discharge tube (4) connected thereto. The whole is merged to form a passage opening for the water in which a potato (5) is entrained according to the arrow P. The cutting member (2) is built up from disk-shaped segments (6) and end plates (7, 8) at the front and rear. Arranged in the cutting member (2) are horizontal knives (9).

Vertically arranged knives are designated by interrupted lines (10). The supply tube (3) has a conical shape with an apex angle of 7°. Due to this shape, the supply tube (3) acts as a diffuser for the water stream supplied through the supply tube (3), with the velocity of the water increasing according as the through-flow opening through the supply tube (3) decreases. Because of the favorable flow properties, no whirls occur, in particular in the area of the transition from supply tube (3) to the cutting member (2).

The discharge tube (4) likewise has a conical shape, with an apex angle of about 7°. Due to this shape, the water stream is decelerated without losses and no transversal flows occur. The whole has a very favorable geometry for a whirl-free passage of the water stream, so that the potato (5) is moved in a straight line along the longitudinal axis in the direction of the cutting member (2).

Figure 2:
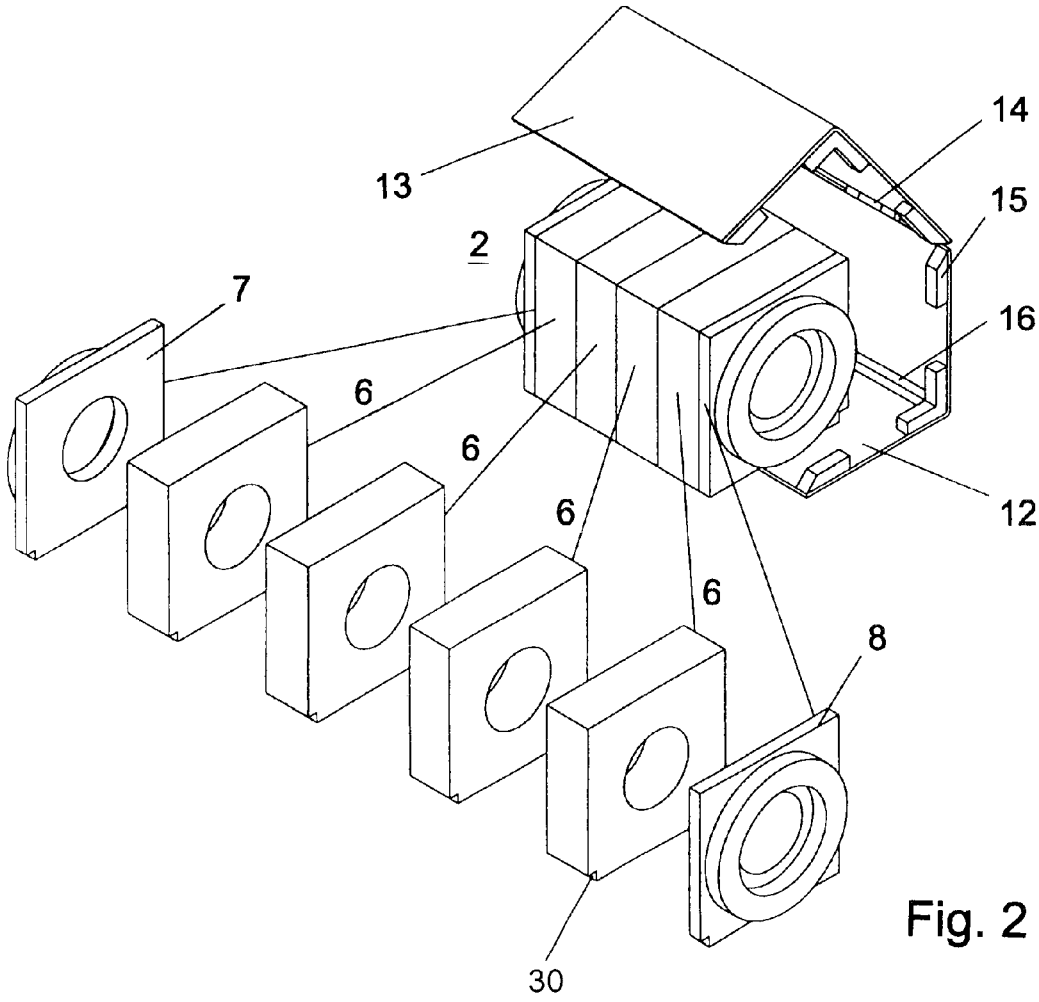
FIG. 2 is an exploded view of a cutting member according to the invention.

In FIG. 2, the cutting member (2) is shown with segments (6) in a casing (11). FIG. 2 also demonstrates how the separate segments (6) in disassembled parts are built up, and how they fit in the casing (11).

The segments (6) are bounded by end plates (7, 8) which can connect to the supply tube (3) and discharge the (4) (shown in FIG. 1). The casing (11) comprises parts (12) and (13) pivotable about a hinge (14). The casing (11) also comprises, at the front and rear, a raised edge (15) which prevents the segments from sliding. The segments (6) have a recess (30), each recess having a mutually unique shape, which recess (30) can engage a correspondingly shaped, projecting edge (16) on the inside of the casing (11).

Figure 3:
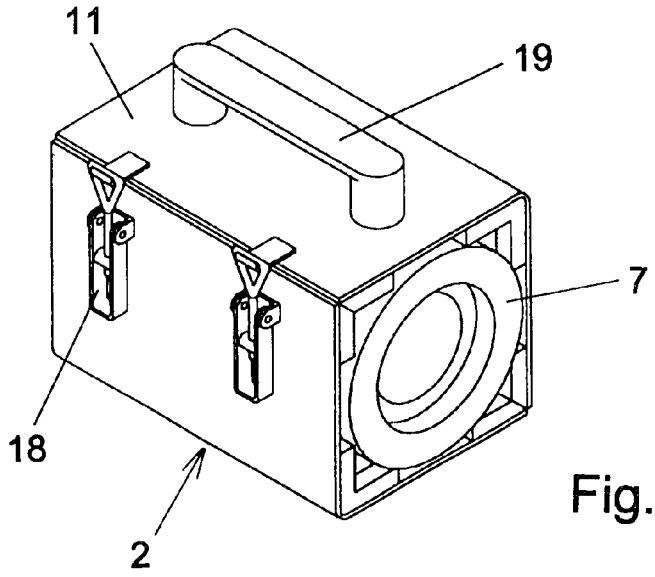
FIG. 3 shows the cutting member with a closed casing.

FIG. 3 shows the cutting member according to the invention with a closed casing (11). The segments, of which only an end plate (7) is visible, are held in position with a clamped fit by the casing (11). The casing (11) is closed through clamping by clamping closures (18). The casing also comprises a handgrip (19).

Figure 4:
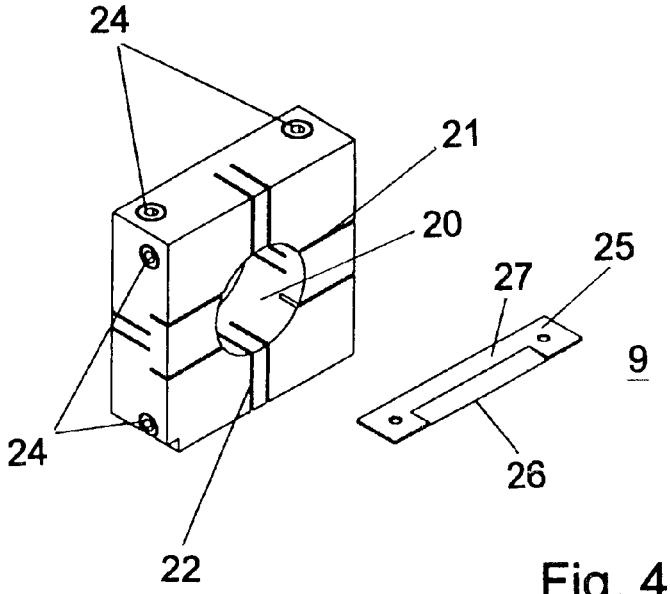
FIG. 4 shows a segment with a knife for a device according to the invention.

FIG. 4 shows a segment (6) for a device according to the invention. The segment (6) has a disk-shaped, substantially square shape with a round opening (20), while provided around the opening (20) are horizontal (21) and vertical (22) slots wherein a knife (28) can be secured.

The segment (6) contains clamping screws (24) whereby a knife (9) can be clamped down in the slots (21, 22) at both ends. The knife (9) has a strip shape, and the part (25) which can be inserted into the slot has a first thickness, and the strip at the location of the cutting face (26) has a second thickness. At the rear (27) of the cutting face (26), the knife (9) has the same thickness as that of the part (25) which can be inserted into the slot.

What is claimed is:

1. A device for cutting potatoes or other vegetables moved through the device by a water stream into slices or sticks, the device comprising:

a supply tube and a discharge tube a cutting member connected to the supply tube and the discharge tube (4) said cutting member divided into a plurality of segments with each segment having an opening, the openings for the plurality of segments together forming a passage for the water stream, one or more knives arranged within the passage for cutting vegetables in the water stream, a casing (11) having pivoting parts which, when closed together by at least one closing member, holds together the segments in a watertight manner.

2. A device according to claim 1, further comprising a pair of end plates connected to the supply tube an discharge tube, said end plates also being held together by the casing.

3. The device of claim 2, wherein the casing securely holds the segments in a fixed mutual position with respect to the other segments in the casing.

4. The device of claim 3, wherein the casing has an internal surface and an inwardly projecting edge extending from the internal surface, and the segments having an external surface and recess on the external surface adapted to engage the inwardly projecting edge of the casing.

5. The device of claim 4, wherein the casing consists of stainless steel.

6. The device of claim 1, wherein the closing members are clamping closures.

7. The device of claim 6, wherein the segments have a disk-shaped, substantially square shape with a round opening, while around the opening horizontal and/or vertical slots are provided wherein the knives can be secured.

8. The device of claim 7, wherein the segments contain clamping screws whereby the knives can be clamped down in the slots at both ends.

9. The device of claim 8, wherein the knives have a strip shape, wherein the part which can be inserted into the slot has a first thickness and the strip at the location of the cutting face has a second thickness, which is less than the first thickness, and wherein the thickness of the cutting face in the direction opposite to the cutting direction, increases to the first thickness.

10. The device of claim 9, the segments are made of aluminum or plastic.

11. The device of claim 2, wherein the supply and discharge tube have a diffuser action.

12. The device of claim 11, wherein the supply tube narrows in the direction of the front end plate and the charge tube widens in the direction from the rear end plate, with an apex angle of approximately 7°.

13. The device according to claim 3, wherein the supply tube narrows in the direction of the front end plate and the discharge tube widens in the direction from the rear end plate, with a apex angle smaller than 15°.

14. The device of claim 13, wherein the smallest passage of the supply tube and discharge tube is identical to the passage of the segments and end plates.

* * * * *